United States Patent [19]

Stratmann et al.

[11] 4,260,460

[45] Apr. 7, 1981

[54] DEVICE FOR QUENCHING GLOWING COKE

[75] Inventors: Josef Stratmann; Manfred Strobel, both of Recklinghausen, Fed. Rep. of Germany

[73] Assignee: Firma Carl Still, Fed. Rep. of Germany

[21] Appl. No.: 16,021

[22] Filed: Feb. 28, 1979

Related U.S. Application Data

[63] Continuation of Ser. No. 865,215, Dec. 28, 1977, abandoned.

[30] Foreign Application Priority Data

Feb. 23, 1977 [DE] Fed. Rep. of Germany ..... 2707672

[51] Int. Cl.[3] ..... C10B 39/08

[52] U.S. Cl. ..... 202/227; 201/39

[58] Field of Search ..... 201/39; 202/227; 73/343 R; 55/260; 110/184; 250/517, 515; 52/218

[56] References Cited

U.S. PATENT DOCUMENTS

| | | | |
|---|---|---|---|
| 1,848,818 | 3/1932 | Becker . | |
| 2,234,826 | 3/1941 | Koppers | 202/227 |
| 2,846,998 | 8/1958 | Robinson | 52/218 X |
| 2,975,106 | 3/1961 | Becker | 202/227 |
| 3,024,344 | 3/1962 | Dills | 73/343 R X |
| 3,231,451 | 1/1966 | Gazelle | 250/517 X |
| 3,522,000 | 7/1970 | Kinney | 55/260 X |
| 3,605,386 | 9/1971 | Erwin et al. | 55/260 X |
| 3,684,664 | 8/1972 | Stratmann et al. | 202/227 |
| 3,772,855 | 11/1973 | Domnitch | 55/260 X |
| 3,806,032 | 4/1974 | Pries | 202/227 X |
| 3,876,143 | 4/1975 | Rossow et al. | 202/227 X |

FOREIGN PATENT DOCUMENTS 60736 3/1968 German Democratic Rep. .

*Primary Examiner*—Frank W. Lutter
*Assistant Examiner*—Roger F. Phillips
*Attorney, Agent, or Firm*—John J. McGlew

[57] ABSTRACT

An apparatus for quenching glowing coke in a coke-quenching container or car, comprises a housing with spaced front and rear vertical walls and vertical end walls at each end having respective entrance and exit openings for the quenching car. The housing also has a ceiling portion adjacent the upper end of a vertically elongated gas chamber defined within the housing and it communicates adjacent the rear wall with an upwardly extending flue. In order to ensure that any sensing devices in the flue are not influenced by the direct radiation from the glowing coke of the quenching car positioned in the chamber, the device includes a baffle extending outwardly from the rear wall and covers a cross-sectional area in the quenching chamber, but leaves a free gas flow cross-section for the flow of quenching gases which is as large as the area covered by the baffle.

6 Claims, 4 Drawing Figures

DEVICE FOR QUENCHING GLOWING COKE

This is a continuation of application Ser. No. 865,215 filed Dec. 28, 1977, now abandoned.

FIELD AND BACKGROUND OF THE INVENTION

This invention relates in general to the construction of coke quenching devices and, in particular, to a new and useful quenching device for coke which comprises a quenching tower having a flue for the flow of quenching gas with a baffle disposed in the quenching chamber portion leaving a flow area for the gases in the chamber at least as large as the area of the baffle. The invention relates particularly to a device for quenching annealed coke, whereby, the coke quenching car is run into a water-sprinkling installation equipped coke quenching chamber. The quenching chamber is connected to a flue for quenching vapors.

DESCRIPTION OF THE PRIOR ART

Of key importance for the settling of solid material components out of the quenching gas clouds is the arrangement of installed parts and the material from which they are built. Such a device is known from German Pat. No. 1,167,792, where the flue is arranged adjacent to the quenching chamber and is connected to it by a cross-sectionally adjustable opening at the base of the flue.

In general, the design of this quenching device has passed reliability tests. Although only a minor amount of solid materials is discharged, a water sprinkling of quenching gas clouds is provided in the flue, and despite a cross-sectional expansion of the flue toward its mouth, a large amount of water in the form of drops is discharged, together with the gas clouds. Because of the acidic content of this water and the wintertime-icing dangerous environment of the quenching tower, this "cokery rain" is undesired and comprises a dangerous emission. In addition, the space requirements for this type of installation are expensive.

However, the principle of making the deflectors and/or builtin parts for the settling of solid material components out of quenching gas clouds inaccessible to the radiant heat of annealed coke has been found to be fully reliable and is essential for highly effective installations for dirt and water separation from quenching gas clouds in coke quenching towers.

Highly effective installations, such as these, are known from a device according to German Pat. No. 2,100,848, where, in order to install slanted gates into dust catcher box racks, set slats are arranged with their upper edge to be used in a louver-like manner from the top and bottom, whereby, the slats of gates used on top at the rack of a dust catcher-louver box point outwardly, and the slats of gates used below on the rack point inwardly, and the dust catcher-louver boxes are built roof-like into the flue with their ridge in the centerline. If, with this device, the gates have slats made of propylene or similar materials, then the dirt and/or solid-material contents of quenching gas clouds emerging from the device and be reduced to 50 gram and less per ton of coke. Propylene installations such as these are sensitive to radiant heat and must be arranged protectively to this effect.

Present engineering requirements call for a less expensive design of a quenching tower of the initially defined type, where the flue installations are inaccessible to the radiant heat of annealed coke.

SUMMARY OF THE INVENTION

According to the present invention, the quenching chamber comprises a rectangular box housing with a rectangular flue disposed over one of its longitudinal halves which is identical in length with the quenching chamber box. One of the longitudinal flue walls and both of the lateral flue walls of the flue align with the quenching chamber walls. The flue free cross-section in the quenching chamber is covered by a cantilever or baffle which is arranged at such a level that the perpendicular cross-sectional area for the free passage of quenching gas clouds between quenching chamber ceiling and cantilever free edge is at least as large as the quenching chamber cross-section not covered by the cantilever or baffle.

According to the invention, it is provided that heat-sensitive deflector installations in the flue are protected against any coke-produced direct heat radiation, and that a sufficiently free cross-section for the drawing-off of quenching vapors on all points is present without a bottleneck at any point leading to a backup. In addition, rerougting through a wall opening in a laterally set-up quenching flue, as with the known device of quenching gas clouds, is also avoided. The device, according to the invention, has a simpler design and requires less space and materials than the known installations. The installations for the water-sprinkling of the coke are arranged under the baffle or canilever.

To obtain better and easier deflection of vapors from beneath the cantilever and further up from beneath the ceiling of the quenching chamber into the flue, the cantilever is preferably slanted upwardly, and the quenching chamber ceiling is provided with a matching slant. The cantilever is also equipped with a regulator plate for any required adjustments.

The materials used for the quenching chamber include reinforced concrete and, for the flue, impregnated wood. The protection, e.g., can be a clinker compound or an impregnated wood paneling.

It is evidently of advantage to also improve the draft in the flue by subdividing its length through vertical lateral walls into several sections. In this way, wind blowing in a longitudinal direction of the coke-quenching device into the flue is prevented from compressing the vapors at the end and pressing them downwardly there and, thus, degrading their drawing-off.

This is also confirmed, for example, by the report by Wagner in the periodical "Brennstoff-Wä-Kraft" (Fuel-Heat-Power) (1060, Vol. 12, issue 11, p. 488), namely, that the admission of air into the quenching chamber blocks the drawing-off of quenching vapors. The free profile of the quenching car run into the quenching chamber is therefore to be designed as narrow as possible and to be developed in the manner of a sluice, e.g., according to German Pat. No. 1,917,660. The quenching water supply tank is advantageously arranged on the quenching chamber ceiling next to the flue.

Accordingly, it is an object of the invention to provide a device for quenching glowing coke which includes a vertically elongated quenching chamber defined by spaced apart front and rear walls and end walls at each end with respective inlet and outlet openings for the passage of a quenching car into the chamber defined between the walls and which also includes a flue formed as a continuation upwardly of the rear wall and having a flue gas flow area and including a cantilever-type baffle extending outwardly from the rear wall into the chamber having an area in the chamber in alignment with the free gas flow area of the flue and leaving a gas flow cross-sectional area in the chamber upwardly to said flue as large as the cross-sectional area of the cantilever-type baffle.

A further object of the invention is to provide a device for quenching glowing coke, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
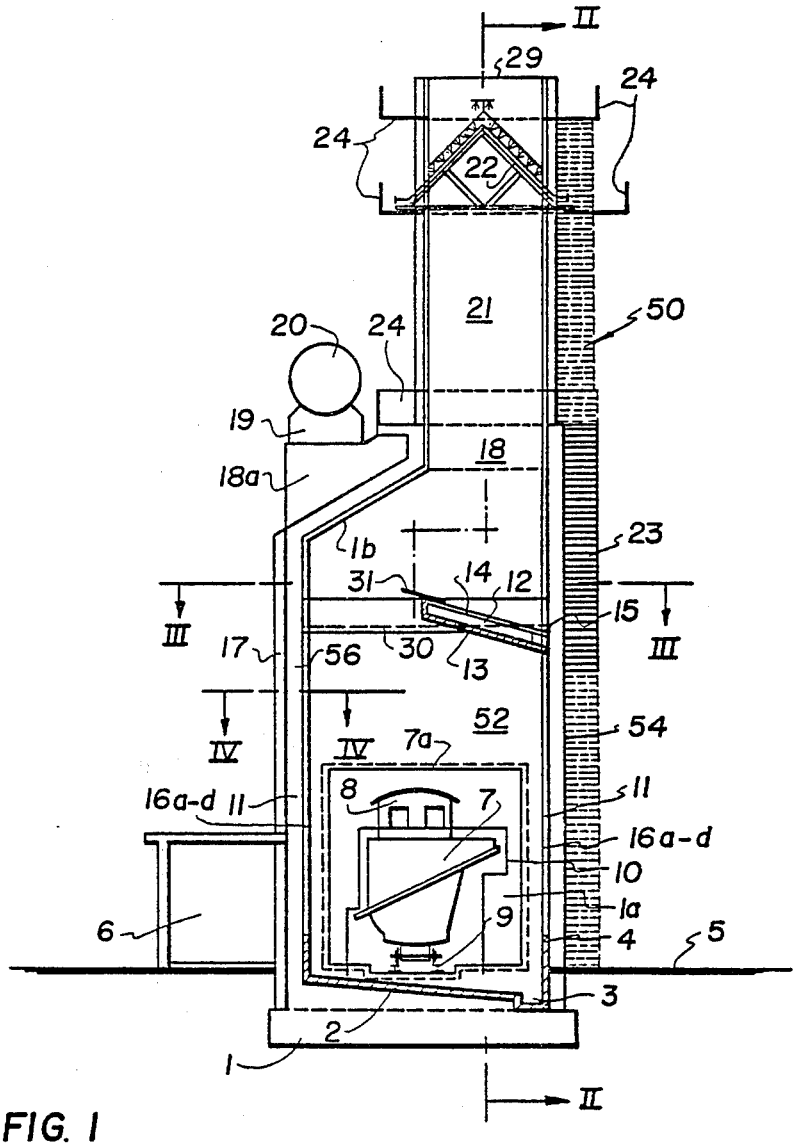
FIG. 1 is a cross-section trhough a quenching tower constructed in accordance with the invention, and taken on the line I—I of FIG. 3.

Referring to the drawings in particular, the invention embodied therein, comprises a coke-quenching tower, generally designated 50, which includes a quenching chamber 52 defined by rear walls 54, a front wall 56, a bottom wall or floor 2 and a sealing portion 1*b*. A flue 21 has an upward free flowing gas area located above chamber 52 and extending upwardly from the rear wall 54. The housing also includes end walls 11 and 11' having a respective entrance opening 58 and exit 60 for a coke-quenching car or container 7.

In the embodiment shown, quenching car 7 includes a locomotive 8 which has wheels engaged on a trackway 9 extending across the floor 2 between the rear wall 54 and the front wall 56. The glowing coke contained in the car is exposed at a top wall 7*a* thereof and it radiates upwardly in chamber 52 and the gases flow upwardly through flue 21. A sprinkler 30 is arranged in the upper portion of chamber 52 for spraying the glowing coke in car 7. A collector and runoff channel 3 is provided for the quenching water and a clinker facing 4 is provided at the lower end of the inner wall 16 of the housing. The outer facings of rear wall 54 and front wall 56 are indicated at 11.

In accordance with the invention, a cantilever or baffle 12 is formed as a concrete bracket plate having a regulator face 31 and a clinker facing 13. A surface protective layer 14 made of a synthetic filler is applied on the top face of the baffle. The lower edge of the baffle has a runoff opening 15 for the condensate of quenching gas clouds.

Figure 4:
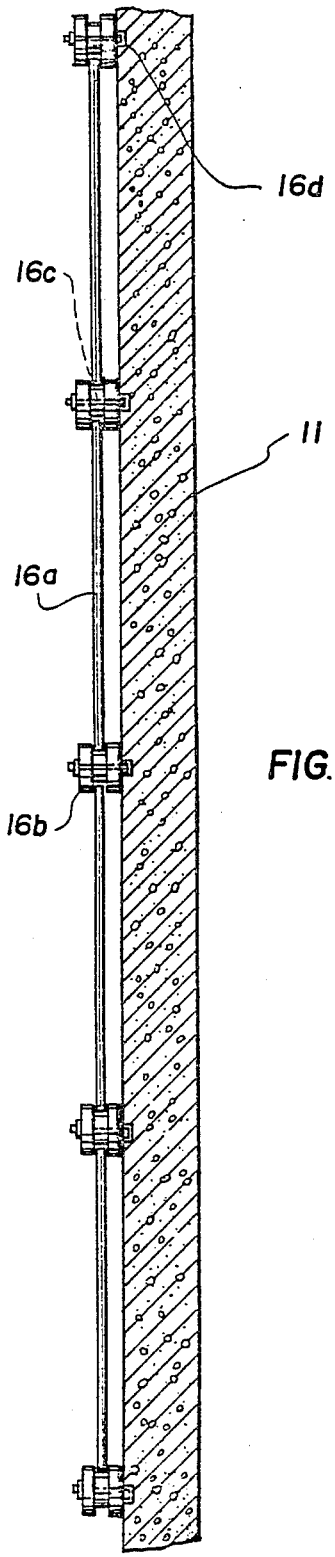
FIG. 4 is a section taken along the line IV—IV of FIG. 1.

Internal linings of the chamber and the quenching flue are shown at 16*a* through 16*d*. 16*a* is a panelling made of impregnated wooden boards, 16*b* are hold-down beams, 16*c* are hold-down screws made of special steel and 16*d* are anchor rails, as shown in FIG. 4. Corner pillars 17 are provided in each corner and concrete beams 18 extend across the upper end of the chamber 52. The ceiling exterior has a bracket 18*a* which supports a base 19 for a quenching water tank 20. A staircase 23 and a catwalk 24 are defined on the structure exterior.

Figure 2:
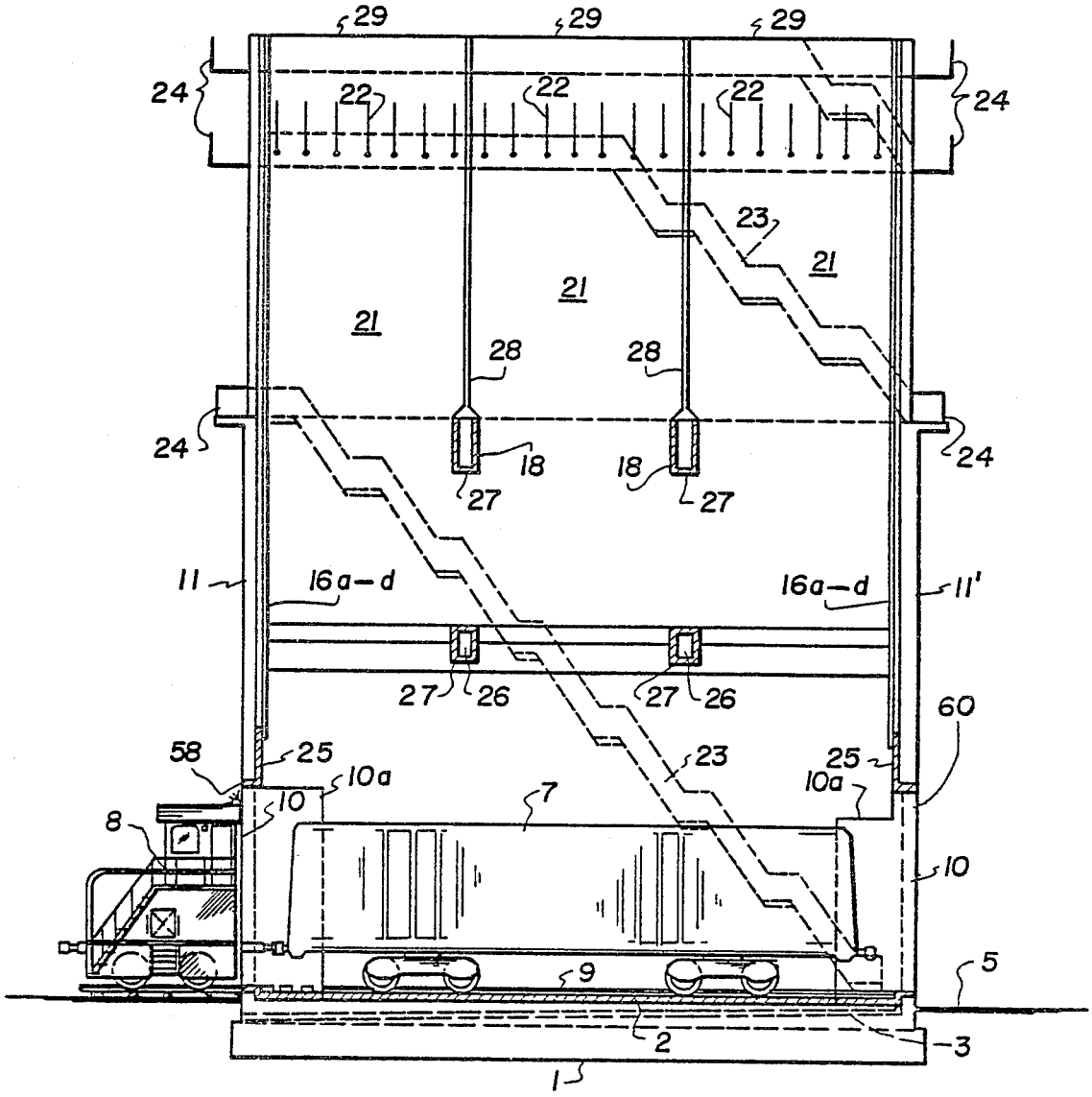
FIG. 2 is a section taken along the lines II—II of FIG. 1.
Figure 3:
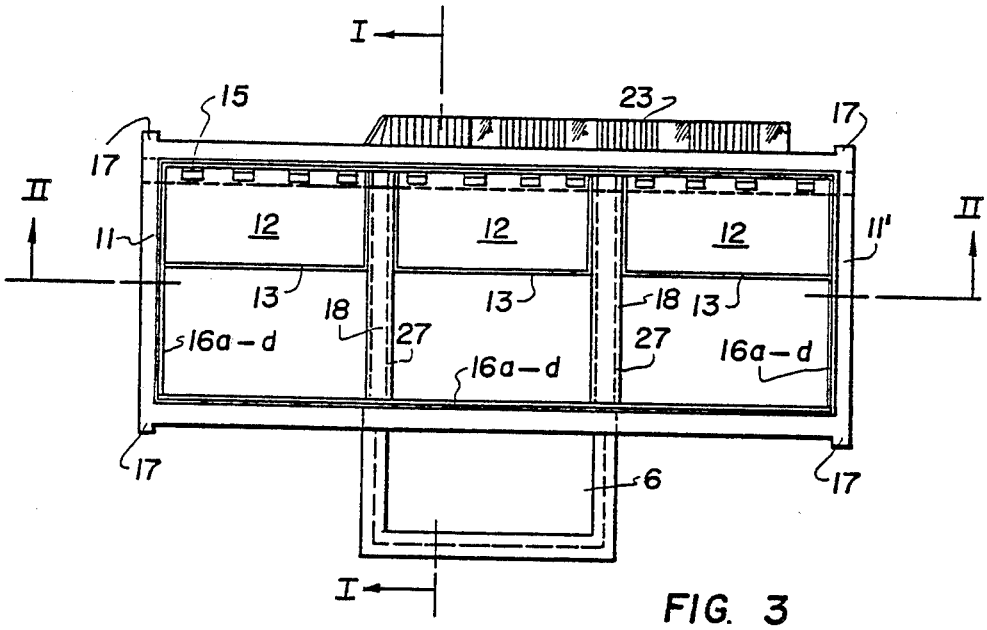
FIG. 3 is a horizontal section taken along the line III—III of FIG. 1.

As shown in FIG. 2, a clinker facing 25 is provided above run-in opening 10. Bracing beam 26 and linings 27 of concrete beams 18 in the quenching flue are formed of clinkers. In addition, partition walls 28 in the quenching flue 21 and 29 in the quenching flue mouth are provided.

While a specific embodiment of the invention has been shown and described in detail to illustrate the application of the principles of the invention, it will be understood that the invention may be embodied otherwise without departing from such principles.

What is claimed is:

1. In an apparatus for quenching glowing coke in a coke-quenching container, having a housing with spaced front and rear vertical walls and a vertical end wall at each end, and having respective entrance and exit openings in the respective end walls for a quenching car, the improvement comprising said housing defining a vertically elongated quenching chamber for the quenching container and having a ceiling portion extending from the top of said front wall at an angle upwardly and toward said rear wall for partly covering the top of said chamber, a flue extending vertically from the top of said chamber adjacent the ceiling portion for covering the remainder of the top of said chamber and which has a flue gas flow area above said chamber for the uptake of gases, heat sensitive deflectors in said flue, and a radiation shield partly overlying said chamber above the quenching car in alignment with said free gas flow section of said flue extending from said rear wall at an angle upwardly and toward said front wall at a location below said ceiling portion and having a gas flow cross-sectional area in said chamber shielding said heat sensitive deflectors in said flue from the radiation of said chamber and having a gas flow cross-sectional area in said chamber around said shield as large as the gas flow area of said flue, said flue having a rear wall and vertical end walls substantially in the plane of said rear wall and vertical end walls of said housing and continuous therewith.

2. An apparatus according to claim 1, further including a regulator plate slidably mounted to said radiation shield on an edge thereof opposite said rear wall for sliding past said edge to vary said gas flow cross-sectional area in said chamber.

3. An apparatus according to claim 1, further including a quenching water tank located outside of said chamber on said ceiling portion, connecting lines from said quenching water tank to the interior of said chamber and sprinklers connected to said connecting lines in said chamber adjacent said radiation shield.

4. An apparatus according to claim 1, wherein said flue is longitudinally subdivided into several sections by vertical lateral walls.

5. An apparatus according to claim 1, wherein said entrance opening includes a gate with an opening therein of a contour of the quenching car to permit the passage of the quenching car with a tight clearance therewith.

6. An apparatus for quenching glowing coke in a coke quenching car comprising a lower rectangular housing defining a quenching chamber having end walls with openings for the entrance and exit of the car, a ceiling covering approximately one half of the top of said rectangular housing, a rectangular flue extending from the top of said rectangular housing covering the remaining portion of the top of said rectangular housing, said flue having a gas flow cross sectional area, and a cantilever shield extending partly across said quenching chamber below said flue and spaced therefrom for shielding said flue from radiation emitted by the glowing coke in the coke quenching car, said cantilever shield leaving a gas flow cross sectional area in said chamber which is substantially equal to said gas flow cross sectional area in said flue, whereby vapors and dust ejected from the quenching glowing coke rise upwardly around said cantilever shield and into said flue.

* * * * *